United States Patent [19]

Heilig

[11] 4,183,546

[45] Jan. 15, 1980

[54] SKATEBOARD

[76] Inventor: Morton L. Heilig, 855 Galloway Street, Pacific Palisades, Calif. 90272

[21] Appl. No.: 904,601

[22] Filed: May 10, 1978

[51] Int. Cl.[2] ..... A63C 17/00

[52] U.S. Cl. ..... 280/87.04 A; 280/11.2

[58] Field of Search ..... 280/87.04 A, 87.04 R, 280/11.2, 11.11 E, 11.1 R, 7.13, 16, 12 H, 47.37, 87.02 R; 180/DIG. 3

[56] References Cited

U.S. PATENT DOCUMENTS

| | | | |
|---|---|---|---|
| 1,070,468 | 8/1913 | Henley | 280/87.04 A |
| 1,075,250 | 10/1913 | Gingold | 280/87.04 R |
| 1,274,889 | 8/1918 | Johnson | 280/87.04 A |
| 1,530,165 | 3/1925 | Fowler | 280/87.04 A |
| 2,200,935 | 5/1940 | Rodriguez | 280/87.04 A |
| 2,953,389 | 9/1960 | Green et al. | 280/87.04 A |
| 3,023,022 | 2/1962 | Boyden | 280/87.04 R |
| 3,203,706 | 8/1965 | Boyden | 280/87.04 R |
| 3,751,062 | 8/1973 | White, Sr. | 280/87.04 A |
| 3,802,524 | 4/1974 | Seidel | 180/DIG. 3 |
| 3,904,215 | 9/1975 | Bardy | 280/11.2 |
| 4,050,705 | 9/1977 | Kreis | 280/11.1 BT |
| 4,060,253 | 11/1977 | Oldendorf | 280/11.28 |
| 4,076,266 | 2/1978 | Krausz | 280/87.04 A |
| 4,076,267 | 2/1978 | Lipscomb | 280/87.04 A |
| 4,120,508 | 10/1978 | Brown et al. | 280/11.28 |

*Primary Examiner*—David M. Mitchell

*Attorney, Agent, or Firm*—William P. Green

[57] ABSTRACT

A skateboard having two pairs of large wheels supporting a board on which a user stands, with the board having a low central deck surface between the two pairs of wheels and raised front and rear portion above the wheels with upper surfaces higher than the central deck surface. Trucks are connected to the underside of the front and rear portions and project downwardly to mount the two pairs of wheels for swinging movement generally about two oppositely inclined axes. A handle post is detachably connectable to the board in either upwardly projecting or rearwardly projecting positions, and additional handles are mounted to the board for swinging movement between active and retracted positions. A brake mechanism is actuable by a manually operated unit through a flexible operating shaft assembly, and may be either held movably in a user's hand or connected to the board, desirably through one of the handles.

3 Claims, 9 Drawing Figures

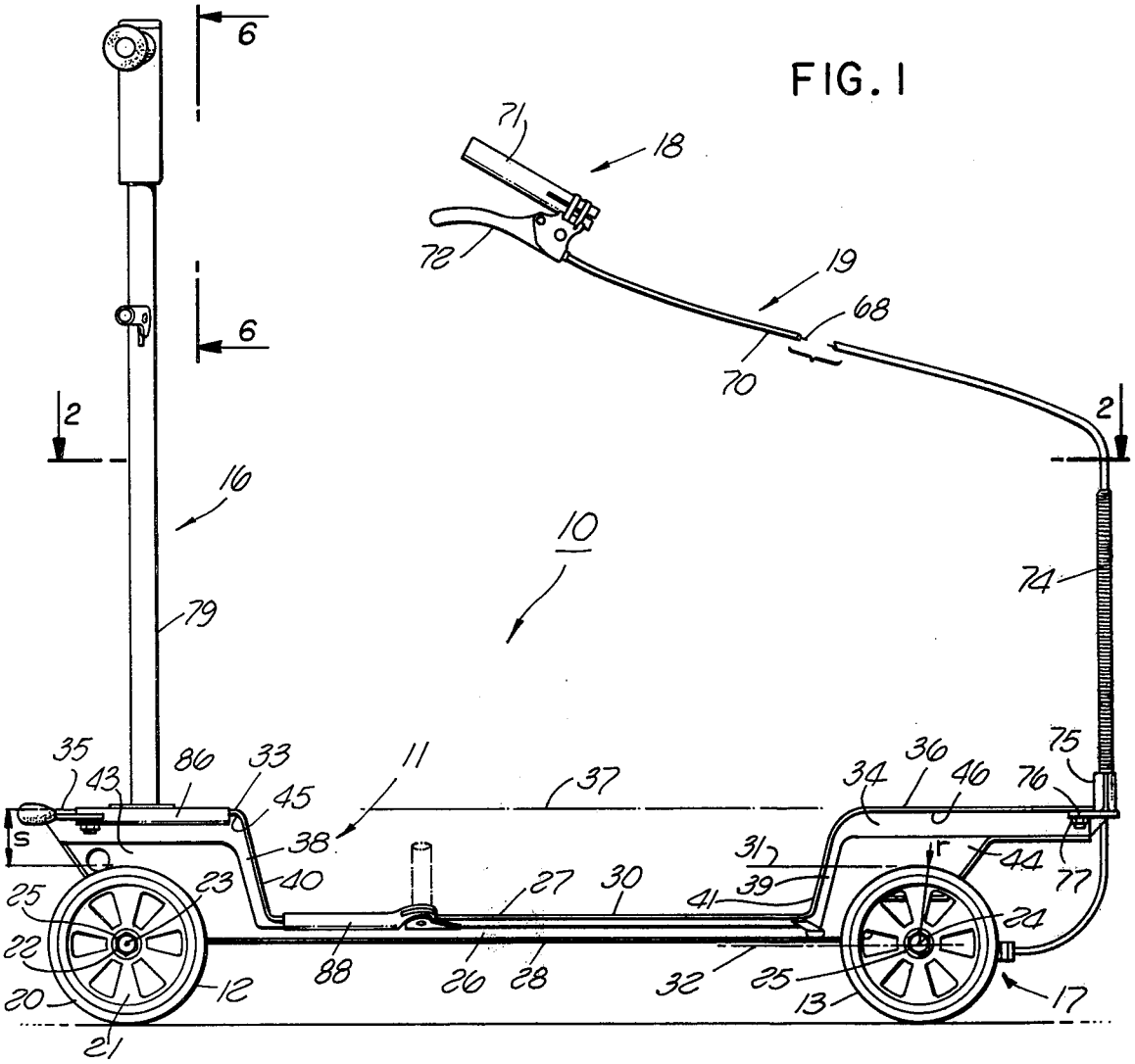
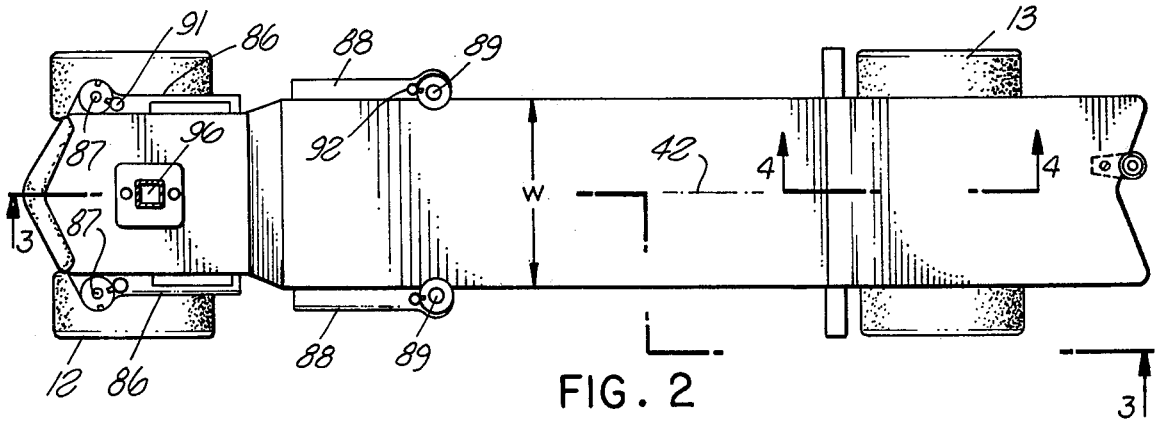
FIG. 2

SKATEBOARD

BACKGROUND OF THE INVENTION

This invention relates to improved skateboards.

The sport of skateboarding has become extremely popular in recent years, but unfortunately has proven very dangerous, and has resulted in many injuries to persons engaging in the activity. Many of these injuries have been caused when the relatively small wheels of a skateboard come into contact with a pebble, twig, or irregularity in the surface on which the skateboard is being used, with the result that one or more of the wheels may be stopped, and the entire device may be either diverted unpredictably to a new course, overturned, or abruptly halted in its motion. The user is then often thrown from the skateboard onto a hard surface, and may be injured severely. Other injuries have been caused by the lack of any provision in a conventional skateboard for slowing or stopping of the board except by "side sliding," a movement which requires time and considerable skill to master. Also, prior skateboards are used in ways for which they are not adequately designed, i.e., kneeling, sitting, lying down, etc., and are so difficult to control as to preclude use by very young children or older persons.

It is understood that there have been some skateboards utilized in the past in which the wheels have been somewhat larger than conventional skate wheels, and in which the board has been cut away at the locations of the wheels to avoid contact therewith. However, such an arrangement leaves the wheels exposed for possible contact with a user's foot, and may in fact in that way tend to cause more accidents than it prevents.

SUMMARY OF THE INVENTION

The general purpose of the present invention is to provide an improved skateboard which is much more stable and safer than prior boards, can travel over a wider variety of surfaces, can be ridden safely in a wider variety of positions, and affords a user more control over the movements of the board than has been possible with prior skateboards, all of which enables the board to be used and enjoyed by persons who may be either too young or too old for the ordinary skateboard. In addition, a board embodying the invention can travel faster than the conventional skateboard. The improved safety and speed are both attained in large part by use of much larger wheels than are normally employed in skateboards, together with a uniquely shaped board structure supported by the wheels. This board structure has a main central portion with an upwardly facing deck surface on which a user normally stands and which is at a relatively low level, beneath the level of the tops of the large wheels, to give the device a low effective center of gravity and corresponding stability in use. At the forward and rear ends of the main central portion, the board has front and rear portions which are received above the front and rear pairs of wheels respectively, and have upper surfaces higher than the level of the main central deck surface. These front and rear portions of the board assist in protecting the user's foot against contact with the wheels, and desirably extend horizontally and are adapted to permit a person to stand or lie partially or wholly on them in some conditions of use of the device. Two wheel mounting trucks are attached to the underside of the front and rear portions of the board, and project downwardly therefrom, and mount the two pairs of front and rear wheels for generally swinging type movement essentially about two oppositely inclined axes. Such inclination of the swinging axes of the trucks gives the board the characteristic capacity to be steered by shifting of the user's weight, as in conventional skateboards.

An additional feature of the invention resides in the provision of a handle post or column which may project upwardly from the forward portion of the skateboard, and which carries a pair of handles, or preferably two pairs of handles, near its upper end, to give the user further control over movements of the board. Desirably, this handle post is detachably connectable to the board either in its upwardly projecting position or a horizontally projecting position in which it in effect increases the length of the board by supporting the knees and legs and enables the person to lie on the board in a horizontal riding position. There may also be other handles attached to the board and mounted to it for swinging movement between laterally projecting active positions and inwardly swung retracted positions adjacent the board.

Another feature of the invention relates to a unique braking mechanism which is controlled by a manually operated actuating unit connected to the brake mechanism by a flexible shaft assembly. The manually operated actuating unit may in some instances be held movably in the user's hand, and in other instances be connected to the board, as by attachment to one of the handles connected thereto. The braking mechanism is preferably mounted to the wheel carrying part of the rear truck assembly and swings with that part about the mentioned inclined pivotal axis of that truck structure.

When the rider of the skateboard is lying in a prone horizontally extending position on the board in use, he preferably positions on the main central portion of the board a filler unit or block which presents an upper surface closer to the level of the top surfaces of the front and rear portions of the board, but desirably still somewhat lower than those top surfaces of the front and rear portions. It is found that this arrangement affords greatest comfort and best stability and control for a person in the prone position.

BRIEF DESCRIPTION OF THE DRAWINGS

The above and other features and objects of the invention will be better understood from the following detailed description of the typical embodiment illustrated in the accompanying drawings, in which:

FIG. 1 is a side elevational view of a skateboard constructed in accordance with the invention, with the forward handle post and the braking mechanism attached;

FIG. 2 is a top plan view taken on line 2—2 of FIG. 1;

DESCRIPTION OF THE PREFERRED EMBODIMENT

Figure 3:
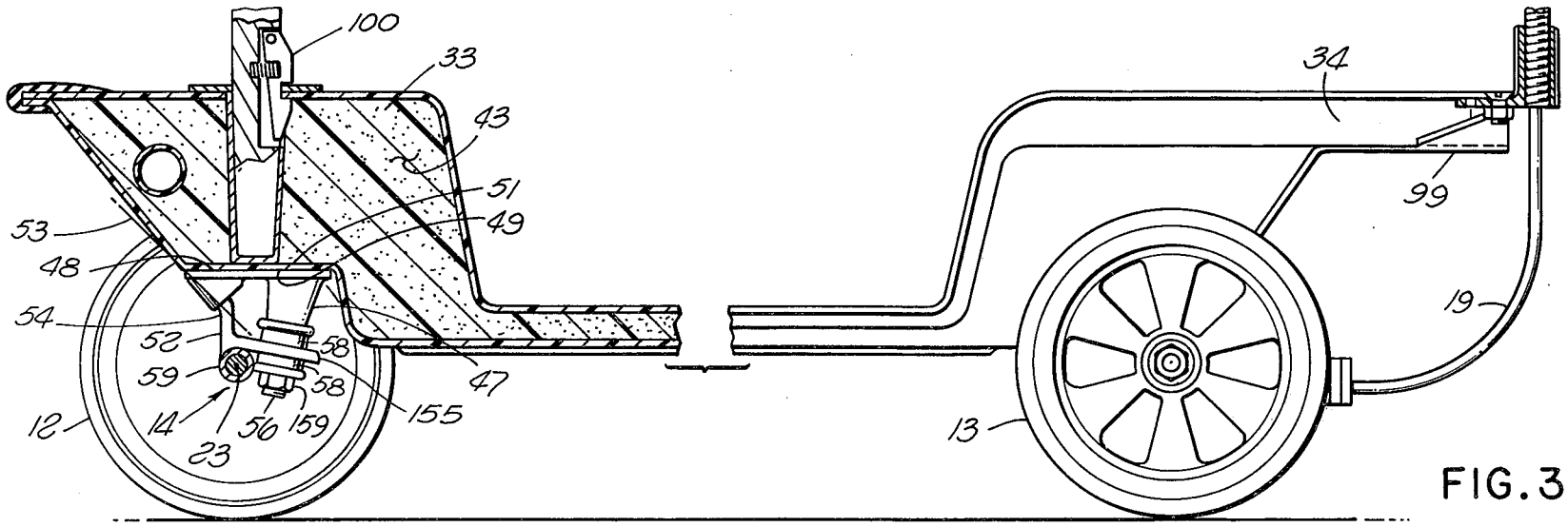
FIG. 3 is an enlarged fragmentary front to rear vertical section taken on line 3—3 of FIG. 2.

Referring first to FIGS. 1 and 2, the illustrated skateboard 10 constructed in accordance with the invention includes a board proper designated by the number 11, supported by a pair of front wheels 12 and a pair of rear wheels 13. The board is supported from the front wheels 12 by a forward truck assembly 14, and from the rear wheels 13 by a rear truck assembly 15. A handle post or column 16 is detachably connectable to the board, and a brake mechanism 17 controlled by a manually operated actuating unit 18 through a flexible connector 19 acts to apply braking force to the rear wheels.

The four wheels 12 and 13 are considerably larger in diameter than conventional skateboard wheels, and more particularly preferably have an external diameter of at least about 5½ inches, desirably approximately 6½ inches. Each wheel has an outer annular tire 20 formed of resiliently deformable elastomeric material such as polyurethane, bonded to and carried by a metal wheel body 21 mounted rotatably by bearings 22 on a transverse axle 23 or 24, with the wheels being retained on the axles by nuts 25 threadedly connected onto the ends of the axles.

Figure 8:
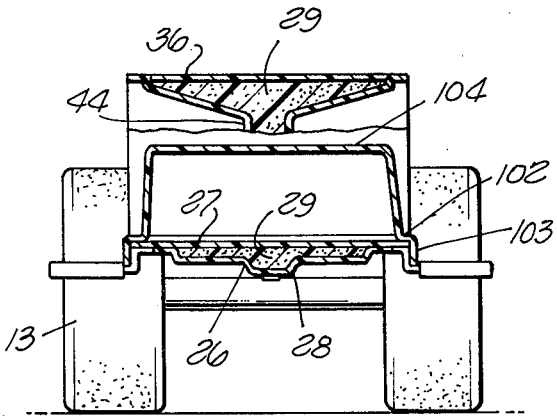
FIG. 8 is an enlarged vertical section taken on line 8—8 of FIG. 7.

The board 11 is essentially rigid, and may be formed of any of various different types of material. For example, the board may be injection molded of appropriate resinous plastic material, may be fabricated of metal, wood, fiberglass or the like, or may be a foam filled plastic structure as shown. In the drawings, the board is typically illustrated as having two essentially rigid vacuum molded top and bottom walls 27 and 28 peripherally secured together to form a hollow structure of resinous plastic material which is filled with a rigid resinous plastic foam substance 29 (FIG. 8).

The board 11 as viewed from the side (FIG. 1) has a main longitudinally central portion 26 between the front and rear pairs of wheels forming at its upper side a horizontal top deck surface 30 on which a person normally stands in using the skateboard. This deck surface 30 is positioned relatively low in order to give stability to the skateboard in use, and in particular is at a level substantially beneath the horizontal plane or level 31 defining the uppermost portions of wheels 12 and 13. Desirably, the level of deck surface 30 is no higher than the midway point between plane 31 defining the uppermost portions of the wheel tires and a plane 32 extending through the axes of rotation of the wheels.

Forwardly of its main central portion 26, the board 11 has a front or forward portion 33, which is higher than central portion 26 to avoid interference with front wheels 12. Similarly, the board has a rear elevated portion 34 higher than central portion 26 to avoid interference with wheels 13. The front and rear portions 33 and 34 have top surfaces 35 and 36 which are desirably horizontal and horizontally aligned with one another, and on which a person or persons may stand, sit or lie in using the skateboard in different ways. The upper deck surfaces 35 and 36 of the front and rear portions of the board are at a level considerably higher than top deck surface 30 of central portion 26, and also substantially higher than the plane 31 extending through the uppermost portions of wheels 13. In a preferred arrangement, the vertical distance between the horizontal plane 37 of upper surfaces 35 and 36 and the horizontal plane of surface 30 is at least as great as and desirably greater than the radius r of each of the individual wheels 12 and 13.

Extending between the main central portion 26 of the board and elevated front portion 23, the board has an abruptly inclined portion 38. A similar but oppositely abruptly inclined portion 39 of the board extends between central portion 26 and the elevated rear portion 34. The inclined upper surfaces 40 and 41 of these portions 38 and 39 merge with or meet surfaces 30, 35 and 36. The surfaces 30, 36 and 41 are all desirably of a common width w (FIG. 2) transversely of the direction of front to rear travel 42 of the skateboard, while forward surfaces 40 and 35 may narrow slightly as shown. It is also contemplated that these various upper surfaces 30, 35, 36, 40 and 41 may all have high friction tread material, such as rubber or a sandpaper type substance (grip tape), covering part or all of their extent, to prevent slippage of a user's shoe on these surfaces.

Projecting downwardly at the underside of front and rear portions 33 and 34 of the board, these portions integrally carry downwardly projecting laterally central ribs 43 and 44, which project downwardly beneath the plane 31 and between the wheels, and to which the trucks 14 and 15 are secured. At opposite sides of ribs 43 and 44, the front and rear portions 33 and 34 of the board have undersurfaces 45 and 46 which are spaced considerably above the plane 31 and the tops of the wheels, and which desirably project laterally far enough to slightly overlap and be received above inner edge portions of the wheels. The vertical spacing s between these undersurfaces 45 and 46 and the uppermost portions of the wheels therebeneath should be equal to at least about one-half of the radius r of wheels 12 and 13, to avoid contact of the front and rear portions 33 and 34 of the board with the wheels during a turn-inducing tilting movement of the body relative to the wheels.

The tilting trucks 14 and 15 may be of essentially conventional construction. For example, forward truck assembly 14 may include an upper rigid bracket part 47 formed of metal or other material having an upper horizontal planar surface 48 which is engageable upwardly against the horizontal undersurface 49 of the central rib or frame part 43 of portion 33 of the frame. This bracket is secured to the rib by screws or other fasteners represented at 50, and typically extending through laterally projecting flanges 51 extending along opposite sides of the lower portion of the rib. The truck also includes a part 52 which is mounted movably to bracket 47 for movement which may be considered as a pivotal or swinging type motion essentially about an inclined axis 53 extending rearwardly and downwardly. For this purpose, the part 52 may have a stub shaft or pivot portion 54 projecting into a socket 55 in bracket 47 and turning therein about the axis 53. At its opposite or lower end, the part 52 may have a circular portion 155 extending loosely about an inclined projection 56 on bracket 47, and clamped between a pair of resilient annular cushion elements 58 retained by a nut 159 and acting to yieldingly resist swinging movement of part 52 about axis 53 relative to bracket 47. The part 52 rotatably carries the two forward wheels 12, and for this purpose has a tubular transversely extending portion 59 through which the wheel mounting axle 23 extends.

The rear truck assembly may be constructed essentially the same as the forward truck, except that the rear truck is mounted reversely so that its inclined pivotal axis 60 is inclined forwardly and downwardly rather than rearwardly and downwardly. As in the case of the forward truck assembly, the rear assembly 15 includes a bracket 61 rigidly secured to rib 44 at the underside of the board, and movably mounting a wheel carrying part 62 for essentially pivotal or swinging movement about inclined axis 60. The upper surface 30 of the central portion 26 of the skateboard body is preferably at least as low as, and desirably lower than, the uppermost portion 48 of each truck assembly, and similarly at least about as low as the upper pivot connections 54, 55 of each truck assembly. This relationship cannot be attained in conventional skateboards, and enables the attainment of performance results not accomplishable with prior boards.

Figure 4:
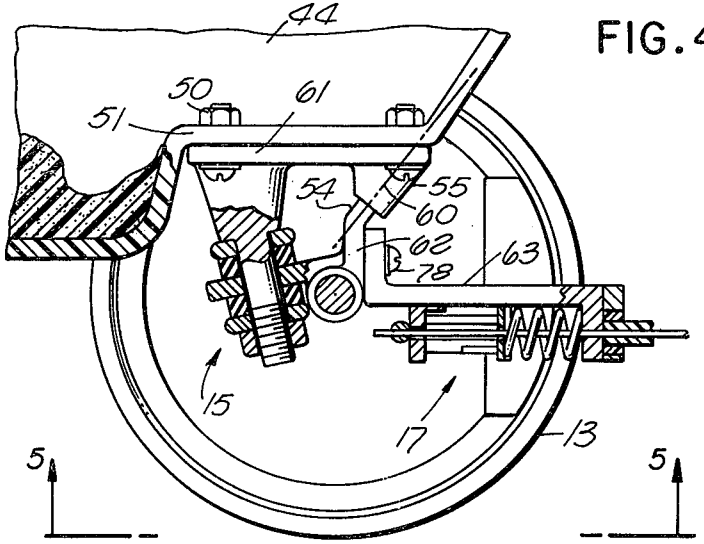
FIG. 4 is a fragmentary vertical section taken on line 4—4 of FIG. 2.
Figure 5:
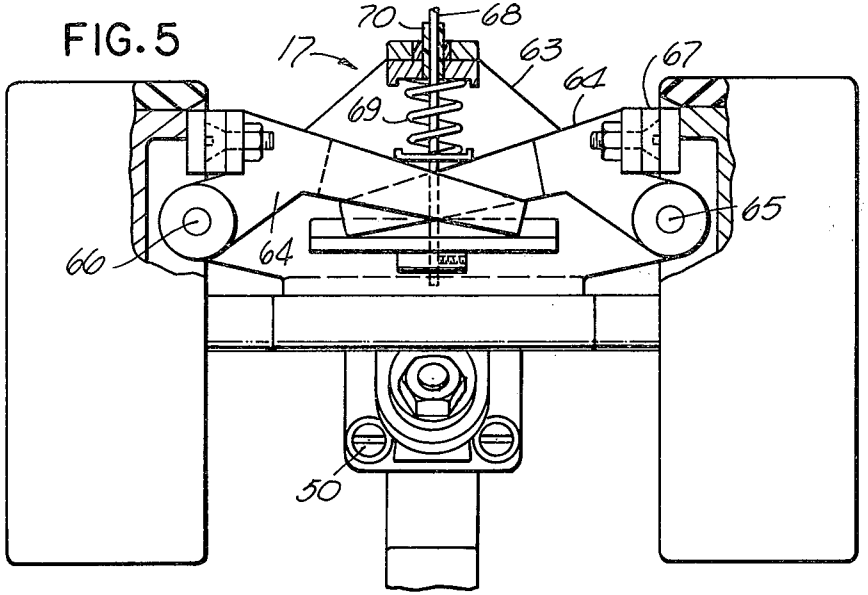
FIG. 5 is a fragmentary inverted plan view (rotated 90° ) taken on line 5—5 of FIG. 4, showing the braking mechanism.

The brake mechanism 17 is illustrated best in FIGS. 4 and 5, and is desirably mounted to the swinging wheel carrying part 62 of the rear truck assembly 15 for pivotal movement therewith about axis 60. The brake mechanism includes a mounting bracket or main body part 63 to which a pair of levers 64 are mounted for pivotal movement about axes 65 and 66. These levers carry brake shoes 67 which are engageable against the inner sides of the two rear wheels to brake them. The levers 64 are in turn actuated by a central axially movable wire 68 of the flexible cable unit 19, with a spring 69 resisting the brake applying movement of the pivoting levers. As will be understood, the flexible unit 19 includes an outer flexible tube 70 through which the wire 68 extends in guided relation, with the manually actuated unit 18 including two handle elements 71 and 72 pivoted together at 73 and acting when these two handle elements 71 and 72 are gripped in the hand of a user and squeezed together to pull wire 68 within and relative to tube 70 and thus apply the brakes to wheels 13. The flexible unit 19 is long enough to permit a person standing on the skateboard to hold manually actuated unit 18 in one of his hands and move that unit to different positions as the user moves his body on the skateboard to control its turning, etc. The flexible cable 19 is also long enough to permit attachment of actuating unit 18 to the various handles of the device as will be later described. For this purpose, one of the handle levers 71 of the unit 18 is formed as an open-ended tube, which is connectable telescopically onto the handles.

In order to assist in preventing the brake cable from contacting the surface on which the skateboard is riding, there may be connected to the rear portion 34 of the board an upstanding flexible coil spring 74 extending about a lower portion of flexible unit 19 and having a stiffness greater than unit 19 to normally maintain the contained portion of that unit in a vertical position, while allowing lateral deformation thereof by deflecting forces. The lower extremity of spring 74 may be connected to a bracket 76 which is detachably secured to portion 34 of the board, as by one or more screws 77. The lower end of spring 74 may be received and retained within a rigid upstanding tube 75 carried by bracket 76. When it is desired to remove the brake from the skateboard, bracket 76 may be detached from the board, and also the main mounting bracket 63 of the brake mechanism may be detached from part 62 of the rear truck 15. To enable such detachment of bracket 63, this part may be secured to part 62 by screws or other fasteners as represented at 78 in FIG. 4.

Figure 6:
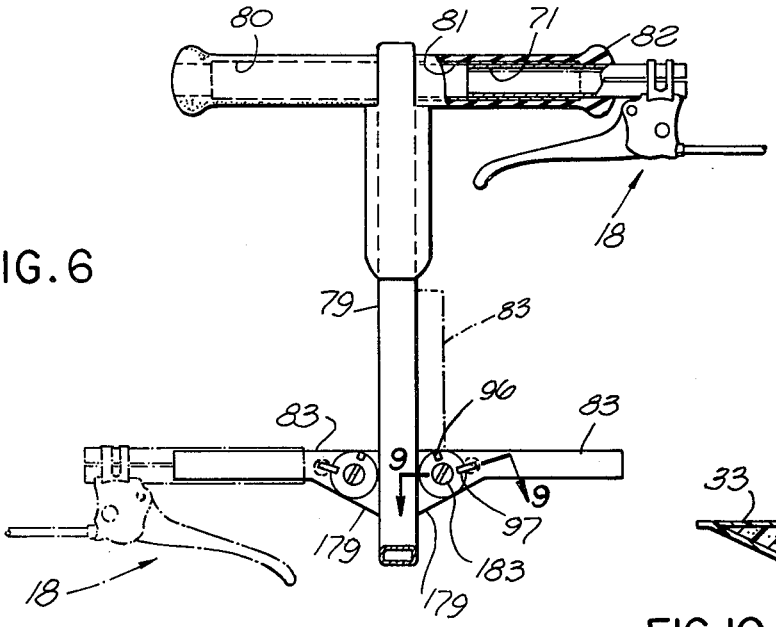
FIG. 6 is a fragmentary vertical section taken on line 6—6 of FIG. 1 and showing the upper handle structure.
Figure 10:
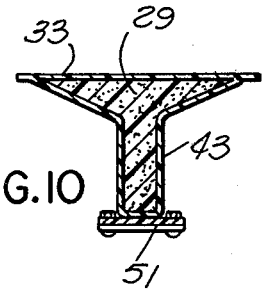
FIG. 10 is a fragmentary vertical section taken on line 10—10 of FIG. 7

The handle post or column 16 includes an elongated, rigid, typically straight member 79 formed of metal or other material and having handles 80 projecting in opposite directions from its upper end. These handles 80 may be formed of metal tubes 81 having resilient tubular grips 82 of rubber or other similar material received thereabout. Tubes 81 may have an internal diameter corresponding essentially to the external diameter of element 71 of the manually actuated brake operating mechanism 18, so that part 71 may be inserted into either of the handle tubes 81 as illustrated in FIG. 6 to mount the manually actuated mechanism to the handle. At a location spaced beneath the upper handles 80, the post 79 desirably carries two additional handle parts 83 which are pivotally connected by a pair of screws 183 to a pair of lugs 179 projecting laterally from post 79, to swing about axes 84 between the oppositely laterally projecting active full line positions of FIG. 6 and the inwardly swung retracted positions illustrated in broken lines and received adjacent the post. Spring pressed detents 85 may be provided on these handles for releasably retaining them in either of their two positions.

A second pair of retractable swinging handles 86 may be pivoted to opposite sides of the forward portion 33 of board 11 at 87, for swinging movement between oppositely laterally projecting active positions and inwardly swung retracted positions adjacent the board. Another pair of such swinging handles 88 may be connected pivotally to the lower central portion 26 of the board at 89, desirably near the forward end of portion 26, and be mounted for swinging movement between oppositely laterally projecting active positions, inclined upwardly to avoid contact with the ground on turning, and inwardly swung retracted positions adjacent the board. Handles 86 and 88 may all be releasably retainable in their active and retracted positions by spring pressed detent elements 91 and 92.

Figure 9:
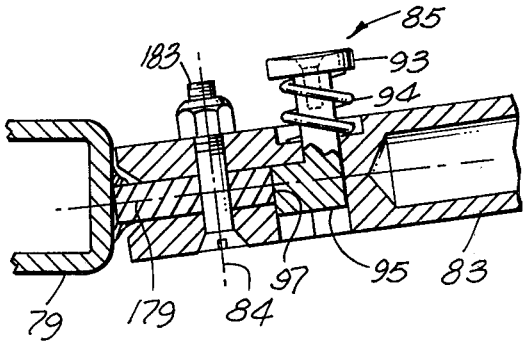
FIG. 9 is a fragmentary vertical section taken on line 9—9 of FIG. 6.

All of the detent elements 85, 91 and 92 for the various retractable swinging handles may typically be identical. One of these detents (a detent 85) is illustrated in FIG. 9, and more specifically is illustrated as having a push-button end 93 depressable axially against the force of a coil spring 94 to move a detenting lug 95 on part 85 into and out of interfitting engagement with two notches 96 and 97 formed at circularly spaced locations in the circular periphery of one of the mounting lugs 179 projecting from post 79.

The manually actuated braking mechanism may also be detachably connectable to each of the swinging handle elements 83, 86 and 88, and for this purpose the internal diameter of tube 71 may correspond to the external diameter of each of the handle elements 83, 86 and 87, to fit telescopically thereover as illustrated in broken lines in FIG. 6.

Post 79 of the handle unit 16 is connected to the board by extension of the lower end of post 79 downwardly in closely fitting relation into a mating socket recess 98 formed in the forward portion 33 of the board. Recess 98 and post 97 are desirably of square or other non-circular horizontal section, to retain the post against turning movement about its vertical axis.

Figure 7:
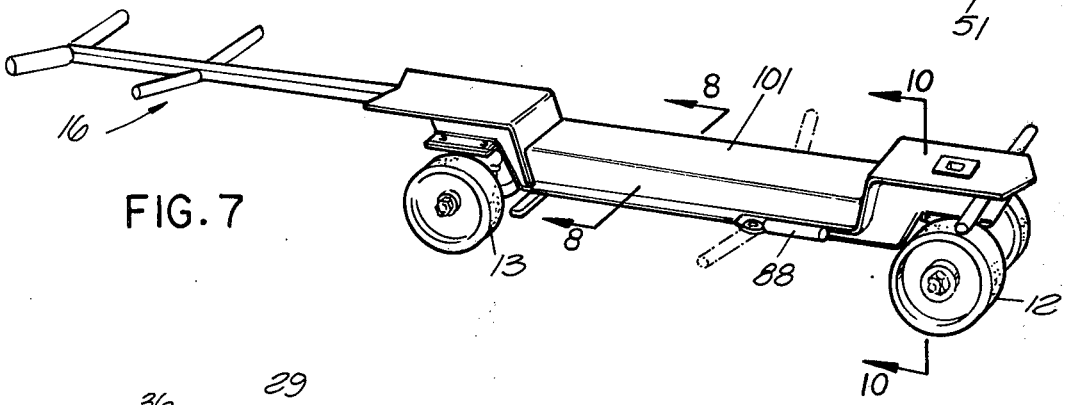
FIG. 7 is a reduced scale perspective view showing the skateboard with the handle in its rearwardly projecting position and with the filler block in place.

As seen in FIG. 7, the post unit 16 may also be connected to the back of board 11 in a rearwardly projecting position, to function as a horizontally projecting extension of the board increasing its effective length. For this purpose, the rear portion 34 of the board contains a horizontally extending rearwardly opening socket recess 99 closely slidably or telescopically receiving the end of post 79 in locating and retaining relation. A spring pressed detent 100 carried by post 79 may have a shoulder engageable against a shoulder formed in a wall of socket recess 99, and engageable also against a shoulder formed in a side wall of socket recess 98, to releasably retain the handle post in either of these recesses, and permit removal therefrom by manual inward depression of the spring pressed detent element 100.

FIG. 7 also illustrates the device when a filler block or unit 101 is positioned on the main deck surface 30 of central portion 26 of the board. This block 101 is essentially rectangular, and shaped to extend the entire front to rear distance between forward and rear portions 33 and 34 of the board. Block 101 is also of a width to extend substantially the entire transverse width of the board. The block 101 may be formed of metal, plastic or other material formed to the cross section illustrated in FIG. 8, to present downwardly facing shoulders 102 engageable with opposite edge portions of surface 30 of the board, with flanges 103 extending downwardly along opposite sides of the board to locate the block against lateral movement relative to the board, and thus retain the block in fixed position on the board. The flanges 103 may be interrupted at the locations of handles 88, in order to avoid interference with those handles. The upper surface 104 of filler block 101 is horizontal, and provides a surface on which a person may lie in prone position on the board. It is found preferable that surface 104 be at a level beneath the plane of upper surfaces 35 and 36 of the front and rear portions of the board, though of course considerably above the level of top deck surface 30 of central portion 26 of the board. This level provides a comfortable support for the chest and abdomen of the prone rider, while still keeping his center of gravity relatively low for good riding stability. The block 101 may be easily removed from its FIG. 7 position on the board by merely moving the block upwardly away from the board.

To now describe some of the various ways in which the board may be utilized, assume first of all that the handle post assembly 16 and the brake assembly 17 and its actuating mechanism have been detached from the board, and that the block 101 is separated from the board and all the handles 86 and 88 are in their retracted positions. With the board in this condition, a user can stand on the deck surface 30 of the central portion 26 of the board and use the board in a manner similar to a conventional skateboard, but with the large size of the wheels acting to prevent interference with the movements of the board by small pebbles or other similar objects or irregularities contacted by the wheels. These large wheels can easily roll over such irregularities without halting of the board or changing its course. At the same time, in spite of the large size of the wheels, the main deck surface 30 is maintained at a very low level, and the entire assembly is therefore very stable, while at the same time the elevated front and rear portions of the board protect the user's feet against contact with the wheels, and by their elevation avoid contact of the wheels with the board in turning. If the central portion of the board were at this same high level, the board would be extremely unstable and would make it difficult for a user's "pumping" foot to reach the ground for effective pushing. Large wheels also permit the board to travel much faster than conventional boards, because of the reduced rolling friction of the larger wheels, and the increased traction against lateral shifting movement of the wheels on the support surface. If desired, a user may sit on rear portion 34 or surface 30, and place his feet or hands on either the board proper or any of the handles 86 or 88 or any combination thereof. These handles can thus function to give increased control over the board to the user.

In order to increase the control over the board in a standing position, the handle post 16 may be connected to the forward portion of the board in the FIG. 1 upstanding position, and the user may then grasp either pair of handles 80 or 83 to hold himself up or exert lateral tilting forces against the board. One person may grasp the handles 80 while a child stands in front of him and grasps the lower handles 83.

If a user desires to lie on the board in a prone position, the handle post 16 is connected in the rearwardly projecting condition of FIG. 7, and the filler block 101 is positioned on the board, so that a person may lie on the filler block and the portions 33 and 34 of the board, and support his rearwardly extending legs or feet on the handles 80 and/or 83 of unit 16. In this condition, either or both of the pairs of handles 86 or 88 may be moved to active position and used as handles for holding the board and tilting it.

In any of these conditions, the brake assembly may either be connected to the board or detached therefrom, and if connected to the board may be either held by the person in his hand in a freely movable but actuable brake-applying condition, or attached to one of the handles 80, 83, 86 or 88, for actuation by a person holding that handle, as previously discussed.

In all conditions of the board, steering is effected by tilting the board laterally in one direction or the other about its front to rear axis 42. As in other skateboards, this lateral tilting movement causes both of the pairs of wheels to swing about their oppositely inclined axes 53 and 60 relative to the board, and thereby cause a turning movement in the direction in which the person's weight is swung. When the weight is again balanced on the board, the cushion elements 58 of the front and rear truck assemblies return the trucks to their normal, non-turning conditions in which the board tends to advance along a straight path.

While a certain specific embodiment of the present invention has been disclosed as typical, the invention is of course not limited to this particular form, but rather is applicable broadly to all such variations as fall within the scope of the appended claims.

I claim:

1. A skateboard comprising:

a board structure having a central portion with an upwardly facing deck surface on which a user may stand;

said board structure having front and rear portions which are at the front and rear ends respectively of said central portion, and which have upper surfaces higher than said deck surface of the central portion;

two front and rear pairs of wheels supporting said board structure and positioned beneath said front and rear portions respectively thereof, and which project upwardly to a level higher than said upwardly facing deck surface of the central portion of the board structure;

a forward truck assembly connected to the underside of said forward portion of the board structure and projecting downwardly therefrom and mounting said front pair of wheels for limited resiliently resisted swinging movement together relative to said forward portion of the board structure generally about a downwardly and rearwardly inclined axis;

a rear truck assembly connected to the underside of said rear portion of the board structure and projecting downwardly therefrom and mounting said rear pair of wheels for limited resiliently resisted swinging movement together relative to said rear portion of the board structure generally about a downwardly and forwardly inclined axis; and a filler unit to be positioned on said central portion of the board structure and having an upper surface on which a user may be supported and which is at a level higher than said deck surface of the central portion of the board structure but lower than said upper surfaces of said front and rear portions of the board structure;

said filler unit having undersurface areas engageable downwardly against said deck surface of the central portion of the board structure to support it thereon, and having flanges projecting downwardly at opposite sides of said central portion to retain the filler unit laterally.

2. A skateboard comprising:

a board structure having a central portion with an upwardly facing deck surface on which a user may stand;

said board structure having front and rear portions which are at the front and rear ends respectively of said central portion, and which have upper surfaces higher than said deck surface of the central portion;

two front and rear pairs of wheels supporting said board structure and positioned beneath said front and rear portions respectively thereof, and which project upwardly to a level higher than said upwardly facing deck surface of the central portion of the board structure;

a forward truck assembly connected to the underside of said forward portion of the board structure and projecting downwardly therefrom and mounting said front pair of wheels for limited resiliently resisted swinging movement together relative to said forward portion of the board structure generally about a downwardly and rearwardly inclined axis; and a rear truck assembly connected to the underside of said rear portion of the board structure and projecting downwardly therefrom and mounting said rear pair of wheels for limited resiliently resisted swinging movement together relative to said rear portion of the board structure generally about a downwardly and forwardly inclined axis;

a post having a first pair of handles projecting laterally near an end thereof and having a second pair of handles spaced from said first handles and mounted to the post for swinging movement between laterally projecting active positions and inwardly swung retracted positions;

means for connecting said post detachably to said front portion of the board structure in an upwardly projecting condition; and means for connecting said post to said rear portion of the board structure in a rearwardly projecting condition.

3. A skateboard comprising:

a board structure on which a user may stand;

two front and rear pairs of wheels supporting said board structure;

forward and rear truck assemblies connected to the board structure and mounting said front and rear wheels for limited resiliently resisted swinging movement relative to the board structure about oppositely inclined axes;

a handle post; and means for connecting said post to said board structure selectively in either an upwardly projecting position or a horizontally projecting position;

said last mentioned means including a socket recess formed in a forward portion of said board structure and adapted to removably receive a lower portion of said post in an upwardly projecting position, and a rearwardly facing socket recess formed in a rear portion of the board structure and adapted to receive said post in a rearwardly projecting position.

* * * * *